US006318234B1

(12) United States Patent
Mate

(10) Patent No.: US 6,318,234 B1
(45) Date of Patent: Nov. 20, 2001

(54) LINE VENT ARRANGEMENT FOR ELECTRO-HYDRAULIC CIRCUIT

(75) Inventor: Edward W. Mate, Manhattan, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/607,049

(22) Filed: Jun. 30, 2000

(51) Int. Cl.[7] ..... F15B 13/043; F15B 13/044
(52) U.S. Cl. ..... 91/453; 91/459; 91/461
(58) Field of Search ..... 91/459, 461, 453, 91/462; 60/399, 327

(56) References Cited

U.S. PATENT DOCUMENTS 4,006,667 2/1977 Bianchetta et al. .
4,362,089 12/1982 Melocik et al. .
5,138,838 8/1992 Crosser .
5,220,862 6/1993 Schexnayder .
5,355,675 * 10/1994 Mayhugh et al. ..... 60/327
6,109,284 * 8/2000 Johnson et al. ..... 137/1

* cited by examiner

*Primary Examiner*—Edward K. Look
*Assistant Examiner*—Michael Leslie
(74) *Attorney, Agent, or Firm*—J. W. Burrows

(57) ABSTRACT

A line vent arrangement is provided to selectively vent pressurized fluid from an actuator in an electro-hydraulic system when an engine of a machine has been shut down. This is accomplished by providing a pressure storage arrangement in parallel with a source of pressurized pilot fluid and an electrically controlled valve that is movable to a position to connect the pressure storage arrangement to the electro-hydraulic directional control valve when the engine of the machine has been shut down.

10 Claims, 1 Drawing Sheet

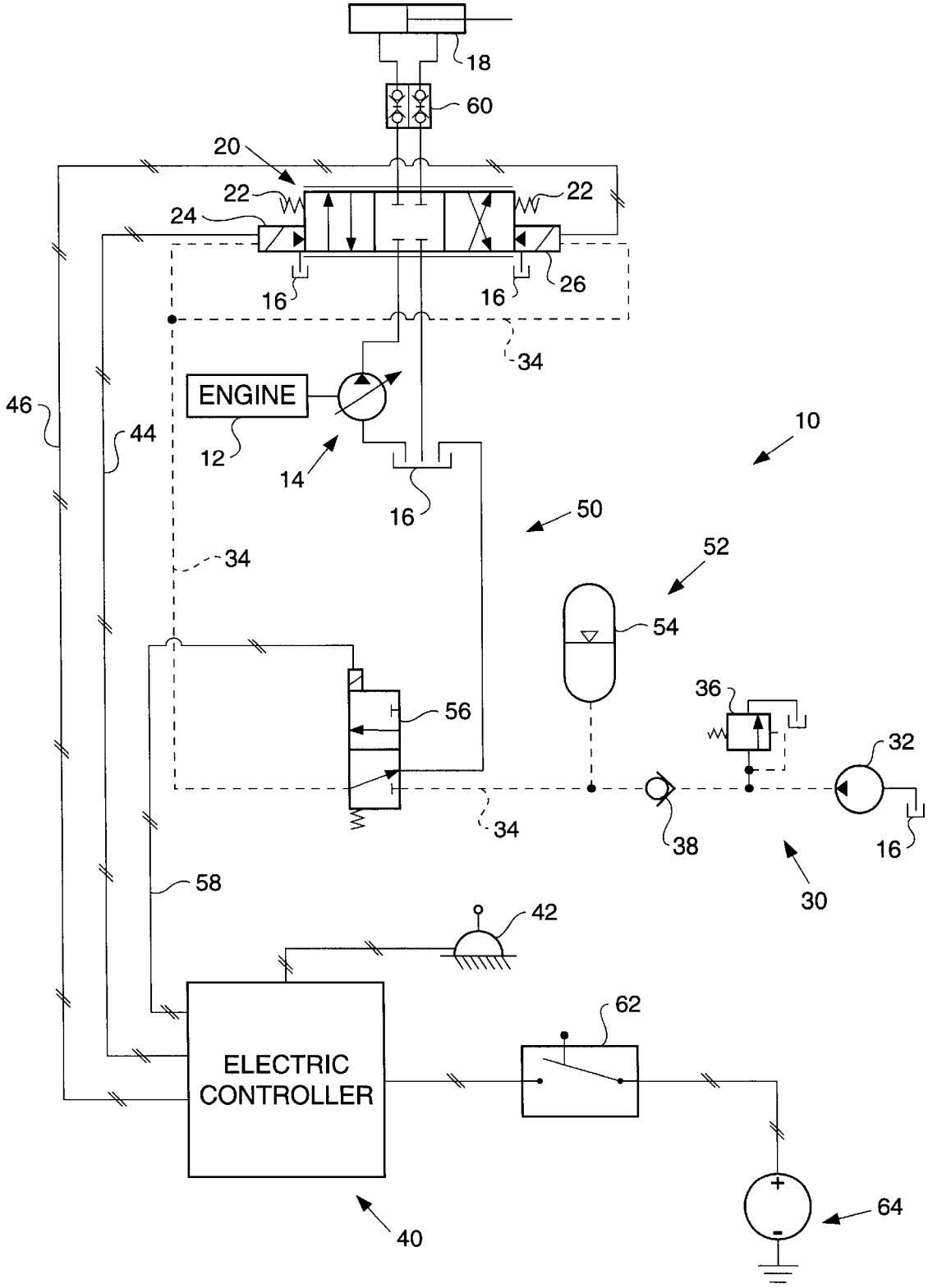
18
60
20
22
22
24
26
16
16
34
ENGINE
46
44
12
14
16
10
50
34
52
54
36
56
32
34
38
16
30
58
42
62
ELECTRIC
CONTROLLER
64
40

LINE VENT ARRANGEMENT FOR ELECTRO-HYDRAULIC CIRCUIT

TECHNICAL FIELD

This invention relates generally to the control of an electro-hydraulic circuit and more particularly to a line vent arrangement for venting an actuator in an electro-hydraulic circuit.

BACKGROUND ART

When turning the engine off on a machine, it is desirable to ensure that no pressure is trapped in any of the actuators. This is very important when it is desirable to change the implement/work tool. Some implements have actuators or motors located thereon and fluid is provided thereto through quick disconnect hydraulic lines. In previous hydraulic systems, the operator was able to mechanically move the main control valve to each of the operative positions with the engine shut down, thus venting any fluid trapped in the associated actuator or motor. In previous electro-hydraulic systems having electro-hydraulic controls associated with the directional control valves, movements of the directional control lever does not permit operation of the directional control valve. This is true since the electrical control merely moves a hydraulic pilot valve which directs pressurized fluid from a source of pressurized fluid to move the main directional control valve. With the engine shut down, there is no power to operate the source of pressurized fluid. Consequently, there is no pressurized fluid to move the main control valve. Such an arrangement is shown in U.S. Pat. No. 5, 138, 838 which issued on Aug. 18, 1992 and assigned to Caterpillar Inc.

The present invention is directed to overcoming one or more of the problems as set forth above.

DISCLOSURE OF THE INVENTION

In an aspect of the present invention, a line vent arrangement is provided for an electro-hydraulic system in a machine having an engine. The electro-hydraulic system has a source of pressurized fluid selectively connected to an actuator through an electro-hydraulic directional control valve, a source of pressurized pilot fluid connected to the electro-hydraulic directional control valve and operative to move the electro-hydraulic directional control valve from its neutral position to its operative position, a reservoir, and an electronic controller. The line vent arrangement includes a pressure storage arrangement connected to the electro-hydraulic directional control valve in parallel with the source of pressurized pilot fluid, an electrically controlled valve disposed between the electro-hydraulic directional control valve and both the source of pressurized pilot fluid and the pressure storage arrangement. The electrically controlled valve is operative, when the engine is shut down, to selectively connect the pressure storage arrangement to the electro-hydraulic directional control valve in response to receipt of an electrical signal from the electronic controller.

In another aspect of the present invention, a method is provided for venting an actuator in an electro-hydraulic system for a machine having an engine. The electro-hydraulic system has a source of pressurized fluid selectively connected to an actuator through an electro-hydraulic directional control valve, a source of pressurized pilot fluid connected to the electro-hydraulic directional control valve and operative to move the electro-hydraulic directional control valve from its neutral position to its operative position, an electronic controller, and a reservoir. The method steps includes connecting a pressure storage arrangement to the electro-hydraulic directional control valve in parallel with the source of pressurized pilot fluid, connecting an electrically controlled valve arrangement between the electro-hydraulic directional control valve and both the source of pressurized pilot fluid and the pressure storage arrangement, moving the electrically controlled valve arrangement to a position, when the engine is shut down, connecting the pressure storage arrangement to the electro-hydraulic directional control valve in response to an electrical signal from the electronic controller to selectively move the electro-hydraulic directional control valve to its operative position, and moving the electrically controlled valve arrangement to a position blocking the pressure storage arrangement from the electro-hydraulic directional control valve in the absence of the electrical signal.

BRIEF DESCRIPTION OF THE DRAWINGS

The sole drawing is a schematic representation of an electro-hydraulic system incorporating the subject invention.

BEST MODE FOR CARRYING OUT THE INVENTION

Referring to the drawing, an electro-hydraulic system 10 is provided for a machine (not shown) having an engine 12. The electro-hydraulic system 10 includes a source of pressurized fluid 14 which receives fluid from a reservoir 16 and is connected to an actuator 18 through an electro-hydraulic directional control valve 20.

The source of pressurized fluid 14 is driven in a well known manner by the engine 12. Even though the source of pressurized fluid 14 is illustrated as a variable displacement pump, it is recognized that it could be a variety of well known sources.

The electro-hydraulic directional control valve 20 is a three-position, infinitely variable control valve that is spring centered and is movable to its operative positions by respective electro-hydraulic pilot valves 24, 26. In the subject arrangement, the electro-hydraulic directional control valve 20 is a closed center valve. That is, all of the ports of the valve are blocked when the valve is in its centered position.

A source of pressurized pilot fluid 30, such as a pilot pump 32, is provided in the electro-hydraulic system and is connected through a pilot conduit 34 to each of the electro-hydraulic pilot valves 24, 26. In a well known manner a pressure relief valve 36 is connected to the conduit 34 generally adjacent the pilot pump 32 and operative to control the maximum pressure level being delivered from the pilot pump 32. A one-way check valve 38 is disposed in the conduit 34 and is operative to permit fluid flow from the pilot pump 32 to the respective electro-hydraulic pilot valves and block reverse flow therethrough. It is recognized that the source of pressurized pilot fluid 30 may be provided by directing pressurized fluid from the source of pressurized fluid 14 through a pressure reducing valve (not shown) to the conduit 34.

An electronic controller 40 is provided in the electro-hydraulic system 10 and operative to receive an electrical signal from an operator input mechanism 42 that is indicative of the operator's input for controlling the actuator 18. The electronic controller 40 receives the electrical signal from the input mechanism 42 and delivers appropriate proportional electrical signals through lines 44, 46 to the respective electro-hydraulic pilot valves 24, 26.

Each of the electro-hydraulic pilot valves 24, 26 operate in a known manner. For example, if the electrical signal is delivered through the line 44 to the electro-hydraulic pilot valve 24, the electrical signal acts to permit pressurized pilot fluid to act on the electro-hydraulic directional control valve moving it towards an operative position in an amount proportional to the magnitude of the electrical signal. When the electrical signal in line 44 is removed, the pressurized pilot fluid in conduit 34 is blocked and the pressurized pilot fluid acting on the electro-hydraulic directional control valve 20 is vented to the reservoir 16. As is well known, movement of the electro-hydraulic directional control valve 20 towards one of its operative positions acts to direct pressurized fluid from the source of pressurized fluid 14 to move the actuator 18 in the desired direction.

The electro-hydraulic system 10 also includes a line vent arrangement 50. The line vent arrangement 50 includes a pressure storage arrangement 52, such as an accumulator 54 that is connected in parallel with the source of pressurized pilot fluid 30 to the respective electro-hydraulic pilot valves 24, 26 of the electro-hydraulic directional control valve 20. The pressure storage arrangement 52 is connected to the conduit 34 downstream of the one-way check valve 38.

An electrically controlled valve 56 is disposed in the conduit 34 downstream of both the source of pressurized pilot fluid 30 and the pressure storage arrangement 52. The electrically controlled valve 56 is a two position valve that is spring biased to a first position at which both the source of pressurized pilot fluid 30 and the pressure storage arrangement 52 are blocked from the respective electro-hydraulic pilot valves 24, 26 of the electro-hydraulic directional control valve 20 and the respective electro-hydraulic pilot valves are vented to the reservoir 16. The electrically controlled valve 56 is movable to its second position in response to receipt of an electrical signal thereto from the electronic controller 40 through a line 58. At the second position of the electrically controlled valve 56, both of the source of pressurized pilot fluid 30 and/or the pressure storage arrangement 52 are connected through the pilot conduit 34 to the respective electro-hydraulic pilot valves 24, 26.

The subject electro-hydraulic system 10 provides a method for venting the lines of actuator 18. The method steps includes connecting a pressure storage arrangement 52, such as an accumulator 54, to the electro-hydraulic directional control valve 20 in parallel with the source of pressurized pilot fluid 30, such as the pilot pump 32, connecting an electrically controlled valve arrangement 56 between the electro-hydraulic directional control valve 20 and both the source of pressurized pilot fluid 30 and the pressure storage arrangement 52, moving the electrically controlled valve arrangement 20 to a position, when the engine is shut down, connecting the pressure storage arrangement 52 to the electro-hydraulic directional control valve 20 in response to an electrical signal from the electronic controller 40 to selectively move the electro-hydraulic directional control valve 20 to its operative position, and moving the electrically controlled valve arrangement 56 to a position blocking the pressure storage arrangement 52 from the electro-hydraulic directional control valve 20 in the absence of the electrical signal.

In some systems, it may be desirable to provide a quick-disconnect arrangement 60 in the fluid lines between the electro-hydraulic directional control valve 20 and the actuator 18. This permits quick and easy disconnecting of the actuator 18 and connecting of another actuator when changing work tools.

In one form of the subject invention, a switch 62 is disposed between the electronic controller 40 and a source of electrical energy 64. The switch 62 is functional to engage the line vent arrangement 50 when the engine 12 is shut down.

It is recognized that various alternatives could be utilized without departing from the essence of the subject invention. For example, the electro-hydraulic directional control valve 20 could be two or more separate valves that collectively function to control movement of the actuator 18.

Industrial Applicability

In the operation of the subject electro-hydraulic system 10, with the engine 12 operational, movement of the operator input mechanism 42 directs an electrical signal to the electronic controller 40 that is representative of the operator's intent to operate the actuator 18. The electronic controller 40 delivers a signal to the electrically controlled valve 56 moving it to its second position and delivers a signal through the appropriate line 44/46 depending on the desired direction of movement of the actuator 18. If, for example, the operator wants to extend the actuator 18, the electrical signal is directed through the line 44 to the electro-hydraulic pilot valve 24. The electrical signal acting on the solenoid of the electro-hydraulic pilot valve 24 acts to open the valve therein to direct pressurized pilot fluid from the source of pressurized pilot fluid 30 to move the electro-hydraulic directional control valve 20 towards the right, as viewed in the drawing, an amount proportional to the magnitude of the electrical signal.

When the operator input mechanism 42 is returned to its neutral position, the electronic controller 40 interrupts the signals in the line 58 and the associated line 44/46. Consequently, the electrically controlled valve 56 returns to its first position blocking the source of pressurized pilot fluid 30 from the respective electro-hydraulic pilot valves 24, 26. Once the electrical signal is interrupted in the associated line 44/46, the valve within the appropriate electro-hydraulic pilot valve 24/26 moves to a position to block any pressurized fluid in the conduit 34 and vents the pressurized fluid acting on the electro-hydraulic directional control valve 20 to the reservoir 16 thus permitting the electro-hydraulic directional control valve 20 to move to its neutral, closed center position.

Movement of the operator input mechanism 42 in the opposite direction acts in a similar manner to retract the actuator 18.

During normal operation of the machine, the source of pressurized pilot fluid 30 functions to maintain the accumulator 54 in a fully charged condition. When the engine 12 is shut down, the source of pressurized fluid 14 and the source of pressurized pilot fluid 30 do not generate any pressurized fluid flow. The one-way check valve 38 functions to inhibit the pressurized fluid in the pressure storage arrangement 54 from venting through the non-functioning source of pressurized pilot fluid 30.

In order to ensure that no pressurized fluid is trapped in the fluid lines between the electro-hydraulic directional control valve 20 and the actuator 18 when the engine is shut down, the operator merely moves the operator input mechanism 42 between its operative positions. Movement of the operator input mechanism 42 in one direction acts to simultaneously send electrical signals to the electrically controlled valve 56 and to the appropriate one of the electro-hydraulic pilot valves 24/26. The electrical signal to the electrically controlled valve 56 acts to move it to its second position which connects the pressure storage arrangement 52 to both of the electro-hydraulic pilot valves 24, 26. The electrical signal being delivered to, for example, the electro-hydraulic pilot valve 24 acts to permit the pressurized fluid in the conduit 34 to move the electro-hydraulic directional control valve 20 to one of its operative positions. When the electro-hydraulic directional control valve 20 is moved to the right as viewed in the drawing, the right end of the actuator 18 is connected to the reservoir 16 thus quickly venting the right end thereof to the reservoir. Since the source of pressurized fluid 14 is not functioning, there is no pressurized fluid being delivered to the left end of the actuator 18. In fact, any pressurized fluid trapped in the left end of the actuator 18 may be partially or fully vented through the non-functioning source of pressurized fluid 14. The operator input mechanism 42 is maintained in the one direction for only a short duration.

The operator then moves the operator input mechanism 42 in the opposite direction which functions to maintain the electrically controlled valve 56 in its second position and the electronic controller 40 delivers an electrical signal to the other electro-hydraulic pilot valve 46 which acts to direct pressurized pilot fluid from the conduit 34 to move the electro-hydraulic directional control valve 20 to its other operative position thus venting the fluid from the left end of the actuator 18 to the reservoir 16. The movement of the operator input arrangement 42 between its operative positions results in the fluid lines to the actuator 18 being vented to the reservoir 16.

Even though the drawing only shows one electro-hydraulic directional control valve 20 and one actuator 18, it is recognized that more than one of each could be utilized with the subject line vent arrangement 50 without departing from the essence of the subject invention. The number of electro-hydraulic directional control valves and actuators would only be limited by the volume of the pressure storage arrangement 50.

Instead of using the operator input arrangement 42 to initiate the sequence of venting of pressure from the lines of the actuator 18 once the engine 12 is shut down, the electronic controller 40 could have a program therein that would be initiated by depressing the switch 62. With the engine 12 shut down, the program within the electronic controller 40 would direct an electrical signal to the electrically controlled valve 56 moving it to its second position. At the same time or subsequent thereto, the electronic controller 40 would direct respective electrical signals to the respective electro-hydraulic pilot valves 24, 26 of each electro-hydraulic directional control valve 20. The respective signals act to momentarily move the electro-hydraulic directional control valves 20 between its operative positions. Each electro-hydraulic directional control valve 20 would be actuated sequentially or simultaneously. Once all of the electro-hydraulic directional control valves 20 are actuated, the program within the electronic controller 40 would end and the electrically controlled valve 56 would return to its first position. By the end of the program, any pressure trapped in the lines to the actuators 18 will have be vented to the reservoir 16.

In view of the foregoing, it is readily apparent that the structure of the present invention provides a line vent arrangement 50 that permits the fluid lines to an actuator 18 to be fully vented after the engine 12 has been shut down.

Other aspects, objects and advantages of this invention can be obtained from a study of the drawings, the disclosure and the appended claims.

What is claimed is:

1. A line vent arrangement for an electro-hydraulic system in a machine having an engine, the electro-hydraulic system having a source of pressurized fluid selectively connected to an actuator through an electro-hydraulic directional control valve, a source of pressurized pilot fluid connected to the electro-hydraulic directional control valve and operative to move the electro-hydraulic directional control valve from its neutral position to its operative position, a reservoir, and an electronic controller, the line vent arrangement comprising:

a pressure storage arrangement connected to the electro-hydraulic directional control valve in parallel with the source of pressurized pilot fluid; and an electrically controlled valve disposed between the electro-hydraulic directional control valve and both the source of pressurized pilot fluid and the pressure storage arrangement and operative, when the engine is shut down, to selectively connect the pressure storage arrangement to shift the electro-hydraulic directional control valve in response to receipt of an electrical signal from the electronic controller.

2. The line vent arrangement of claim 1 wherein the pressure storage arrangement is an accumulator.

3. The line vent arrangement of claim 1 wherein the electro-hydraulic directional control valve is a closed-center valve.

4. The line vent arrangement of claim 1 wherein the source of pressurized pilot fluid is a pilot pump.

5. The line vent arrangement of claim 1 wherein the electrically controlled valve is a two-position valve that is spring biased to a position at which the source of pressurized pilot fluid is blocked from the electro-hydraulic directional control valve and the electro-hydraulic directional control valve is vented to the reservoir and movable to a second position at which the source of pressurized pilot fluid is open to the electro-hydraulic directional control valve and the electro-hydraulic directional control valve is blocked from the reservoir.

6. A method for venting an actuator in an electro-hydraulic system for a machine having an engine, the electro-hydraulic system having a source of pressurized fluid selectively connected to the actuator through an electro-hydraulic directional control valve, a source of pressurized pilot fluid connected to the electro-hydraulic directional control valve and operative to move the electro-hydraulic directional control valve from its neutral position to its operative position, an electronic controller, and a reservoir, the method comprising the steps of:

connecting a pressure storage arrangement to the electro-hydraulic directional control valve in parallel with the source of pressurized pilot fluid;

connecting an electrically controlled valve arrangement between the electro-hydraulic directional control valve and both the source of pressurized pilot fluid and the pressure storage arrangement;

moving the electrically controlled valve arrangement to a position, when the engine is shut down, connecting the pressure storage arrangement to the electro-hydraulic directional control valve in response to an electrical signal from the electronic controller to selectively move the electro-hydraulic directional control valve to its operative position; and moving the electrically controlled valve arrangement to a position blocking the pressure storage arrangement from the electro-hydraulic directional control valve in the absence of the electrical signal.

7. A line vent arrangement for an electro-hydraulic system in a machine having an engine, comprising:

a source of pressurized fluid;

a reservoir;

an electro-hydraulic directional control valve connected to the source of pressurized fluid and the reservoir;

an actuator selectively connected to the source of pressurized fluid and the reservoir through the electro-hydraulic directional control valve;

a source of pressurized pilot fluid;

an electronic controller operative to selectively connect the source of pressurized pilot fluid to the electro-hydraulic directional control valve;

a pressure storage arrangement connected to the electro-hydraulic directional control valve in parallel with the source of pressurized pilot fluid; and an electrically controlled valve disposed between the electro-hydraulic directional control valve and the source of pressurized pilot fluid and the pressure storage arrangement.

8. The line vent arrangement of claim 7 wherein the electrically controlled valve is movable to a position at which the pressure storage arrangement is selectively connected, when the engine is shut down, to the electro-hydraulic directional control valve in response to receipt of an electrical signal from the electronic controller.

9. The line vent arrangement of claim 8 wherein the electro-hydraulic directional control valve is a closed center valve.

10. The line vent arrangement of claim 9 wherein the pressure storage arrangement is an accumulator.

* * * * *